US005224798A

United States Patent [19]

Thomas

[11] Patent Number: 5,224,798

[45] Date of Patent: Jul. 6, 1993

[54] OVERLOADING DEVICE FOR A JACK-UP OIL PLATFORM AND PLATFORM INCLUDING THE DEVICE

[75] Inventor: Pierre-Armand Thomas, Puteaux, France

[73] Assignee: Technip Geoproduction, Paris la Defense, France

[21] Appl. No.: 651,723

[22] Filed: Feb. 6, 1991

[30] Foreign Application Priority Data

Feb. 8, 1990 [FR] France ..... 90 01475

[51] Int. Cl.[5] ..... E02B 17/00

[52] U.S. Cl. ..... 405/198; 405/196; 405/204

[58] Field of Search ..... 405/196, 197, 198, 199, 405/205; 254/105, 107, 112

[56] References Cited

U.S. PATENT DOCUMENTS

| | | | |
|---|---|---|---|
| 2,992,812 | 7/1961 | Rasmussen et al. | 405/198 X |
| 3,044,269 | 7/1962 | Le Tourneau | 405/198 |
| 3,277,653 | 10/1966 | Foster . | |
| 3,797,256 | 3/1974 | Giblon | 405/196 |
| 4,255,069 | 3/1981 | Yielding . | |
| 4,456,402 | 6/1984 | Boon | 405/196 |
| 4,482,272 | 11/1984 | Colin | 405/196 |
| 4,505,615 | 3/1985 | Evans | 405/196 |

FOREIGN PATENT DOCUMENTS

| | | | |
|---|---|---|---|
| 0025618 | 3/1981 | European Pat. Off. . | |
| 0059218 | 5/1980 | Japan | 405/197 |

OTHER PUBLICATIONS

Ports and Dredging, No. 88, 1976, pp. 11-13, NL; "Mearsk Explorer. Groot booreiland voor Deense rekening", p. 12, lines 4-7.

*Primary Examiner*—Dennis L. Taylor

*Attorney, Agent, or Firm*—Wenderoth, Lind & Ponack

[57] ABSTRACT

A platform comprises a hull mounted on legs such that it can be moved relative to the legs be by jack mechanisms disposed in a carrying structure. The jack mechanisms include a plurality of output gear pinions which cooperate with racks mounted along at least a part of the length of the legs. The hull is provided with a first device for applying an overload on the leg through the jack mechanisms. A second overload device is also provided an includes at least one additional load which is temporarily and directly lockable to each leg of the platform when the legs are being set on the sea bed.

6 Claims, 6 Drawing Sheets

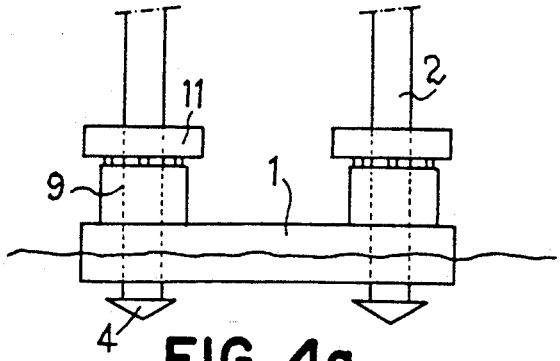
FIG. 4a
FIG. 4b
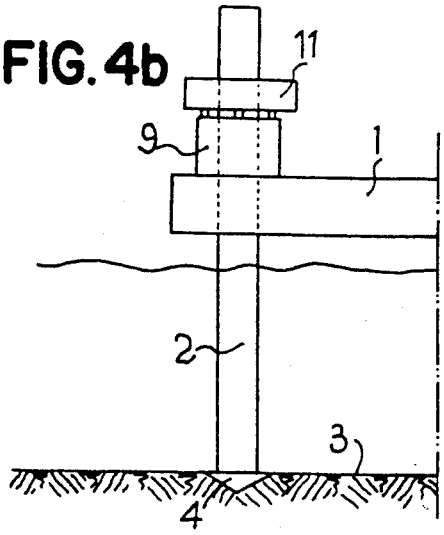
FIG. 4c
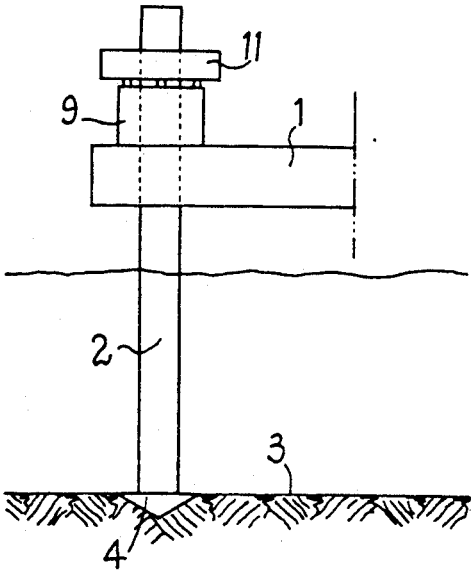
FIG. 4d
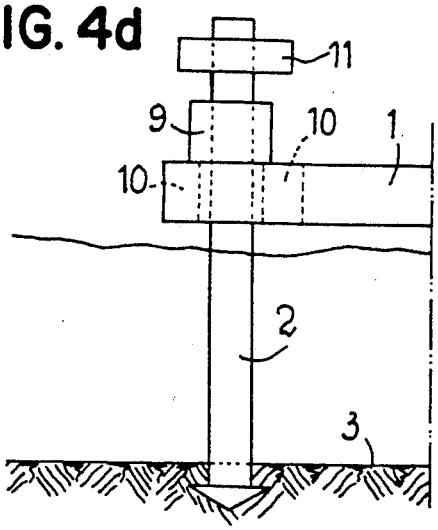
FIG. 4e
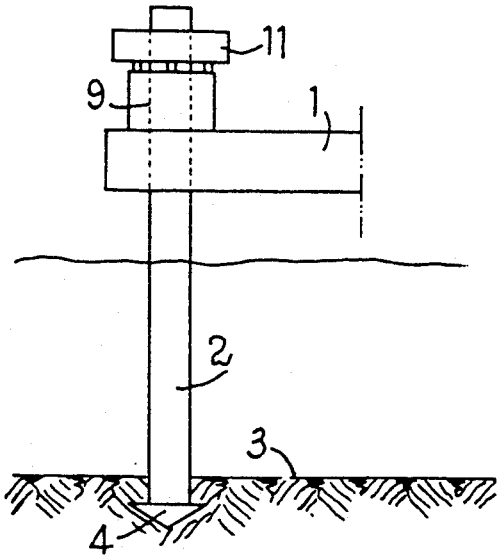
FIG. 4f
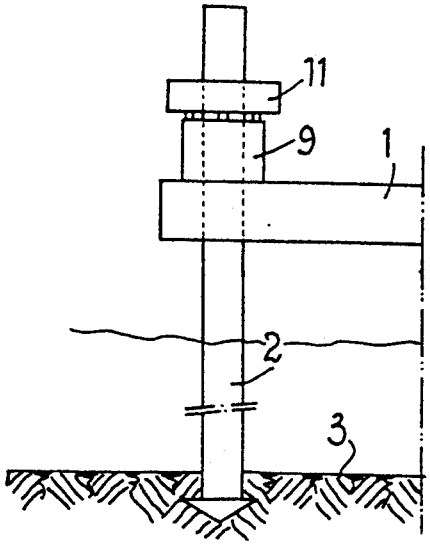

OVERLOADING DEVICE FOR A JACK-UP OIL PLATFORM AND PLATFORM INCLUDING THE DEVICE

BACKGROUND OF THE INVENTION

The present invention relates to offshore jack-up oil drilling and production platforms and more particularly to a device for overloading this type of platform.

The platforms of this type usually comprise legs which bear against the sea bed and a hull which is movable and adjustable in height along the legs.

The hull of the platform is brought in a floating state to the drilling or production site and the legs are lowered into contact with the sea bed. Then, by bearing against the legs, the hull is jacked up above the level of the sea at a height which puts it out of reach of the highest waves.

The hull is therefore movable along the legs of the platform by jack mechanisms disposed in a carrying structure which is well known to those skilled in the art by the name "Jack-house". These jack mechanisms comprise output gear pinions cooperating with racks mounted on at least a part of the length of the legs. These pinions are driven by a plurality of motors associated with speed reducers whose speed reduction ratio is very high.

Further, each leg is provided in its lower part with a foot, for example of hexagonal shape, which bears against the sea bed.

When laying the legs of the platform on the sea bed, safety standards require the operators to apply on the legs an overload which may be as much as 1.25 times the load of the platform. This overload has for its purpose to achieve a stable anchoring of the legs, especially on sites where the feet have a tendency to sink in due to the instability of some layers of the subsoil.

For this purpose, the hull of the platform is provided with, in addition to the exploitation equipment and living quarters, chambers integrated with the hull which may be filled with sea water when laying the legs on the sea bed. In this way there is created an overload which is transmitted to the legs through the jack mechanisms.

However, safety standards are becoming increasingly severe and consequently the overload required to be applied to the legs is increasing.

One solution would consist in increasing the number of the chambers in the hull of the platform.

Now, as the available space in the hull is limited, it would be necessary to increase the dimensions of the hull. This would result in greater weight and higher drag forces when towing the platform.

Further, this arrangement would subject the jack mechanisms and in particular the output pinions to a high load which would require increasing the size of these pinions.

SUMMARY OF THE INVENTION

An object of the invention is therefore to provide an overloading device for a platform which complies with the safety standards, is of simple construction and yet avoids applying this overload directly on the jack mechanisms of the platform.

The invention therefore provides an overloading device for a jack-up oil platform comprising a hull mounted on legs to be movable therealong by jack mechanisms disposed in a carrying structure and comprising a plurality of output gear pinions cooperating with jacks mounted on at least a part of the length of the legs, the hull is provided with means for applying an overload on the legs through the jack mechanisms. The device comprises at least one additional load which is temporarily and directly lockable to each leg of the platform when laying the legs on the sea bed. The additional load is formed by removable reservoirs including means for automatically connecting the reservoirs to and unlocking the reservoirs from the legs of the platform.

The device according to the invention may have the following further advantageous features:

the reservoirs are supported by the carrying structure of the jack mechanisms;

the reservoirs are formed by at least one rigid enclosure;

blocks of elastic material are disposed between the reservoirs and the carrying structure of the jack mechanisms;

the reservoirs are formed by at least one flexible bag of elongated shape disposed within each leg of the platform;

a plurality of flexible bags are provided and connected to one another and to means for connecting the bags to the legs of the platform;

the superimposed flexible bags communicate with one another.

The invention also provides a jack-up platform for offshore drilling, comprising a hull movably mounted on legs adapted to bear against the sea bed, and characterized in that each leg is provided with an overloading device of the type defined hereinbefore.

BRIEF DESCRIPTION OF THE DRAWINGS

A better understanding of the invention will be had from the following description which is given solely by way of example with reference to the accompanying drawings, in which:

FIGS. 4*a* to 4*f* are diagrammatic elevational views showing procedural steps for placing the oil platform in position;

DETAILED DESCRIPTION OF THE INVENTION

Figure 1:
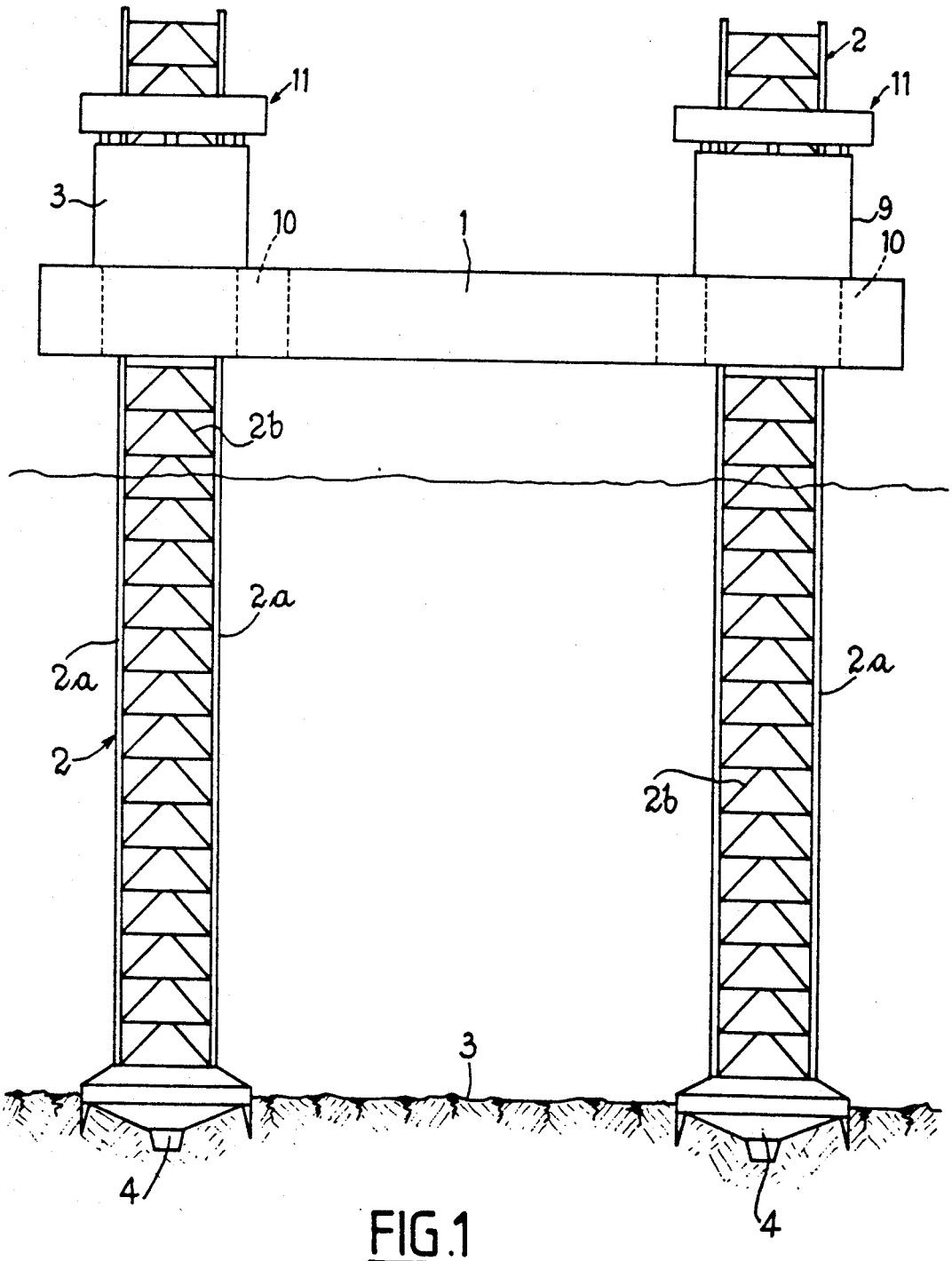
FIG. 1 is a diagrammatic elevational view of a jack-up oil platform provided with an overloading device according to the invention.

FIG. 1 shows diagrammatically a jack-up oil platform comprising a hull 1 movably mounted on vertical legs 2 which are adapted to bear against the sea bed 3 when the platform is in the drilling or production position.

Each of the vertical legs has, in the presently-described embodiment, a triangular cross-sectional shape and consists of three posts 2*a* interconnected by a jacket or lattice structure 2*b* formed of metal girders.

The vertical legs 2 may also have square or circular cross-sectional shapes.

Each leg 2 terminates at its lower end in a foot 4 which has a hexagonal shape in the presently-described embodiment.

The platform is equipped in the region of each leg 2 with jack mechanisms 5 for jacking up the hull 1 with respect to the legs. These jack mechanisms 5 enable the legs 2 to be lowered into contact with the sea bed 3, and then, by bearing against the legs, enable the hull 1 to be jacked up above the sea to an altitude which puts the hull out of reach of the highest waves.

Figure 2:
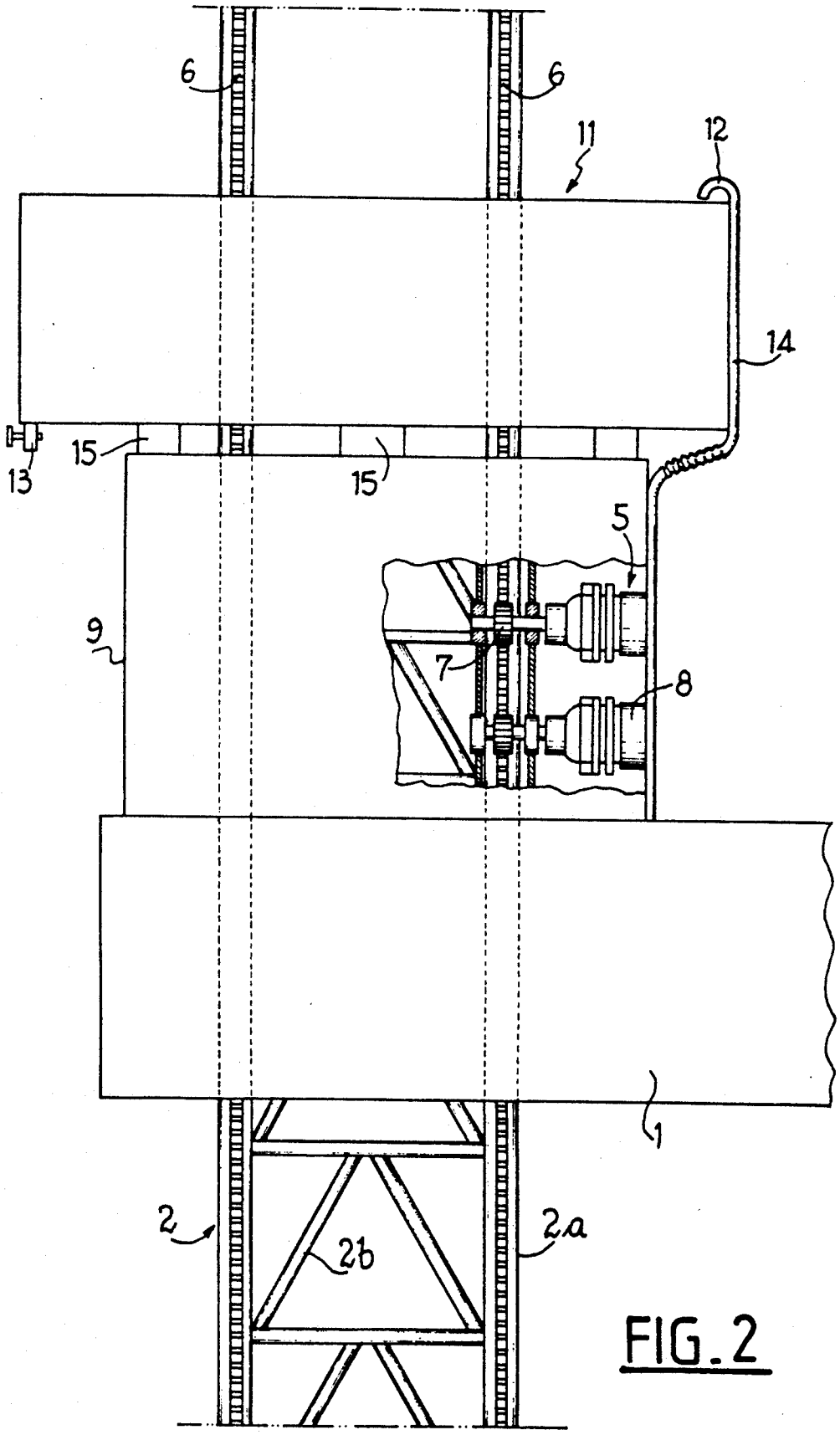
FIG. 2 is a partially cut away diagrammatic view on a larger scale of one of the legs of the platform showing a part of the jack mechanisms and the overloading device according to the invention.

For this purpose, and as shown in FIG. 2, the posts 2*a* of the legs 2 are provided with racks 6 which are diametrically opposed and disposed on a part of the length of the legs 2 which cooperate with output gear pinions 7 of the jack mechanisms 5. For example, six output pinions 7 may be provided for each post 2*a*, with each of the pinions being provided with a driving motor 8.

The jack mechanisms 5 are disposed within a carrying structure 9 mounted on the hull 1.

Further, the hull 1 is provided with the usual exploitation equipment, living quarters, and chambers 10 (FIG. 1) which are integrated with the hull and may be filled with sea water by suitable means (not shown) when laying the legs 2 on the sea bed 3. In this way there is created an overload which is transmitted to the legs 2 through the jack mechanisms 5.

The purpose of this overloading is to achieve a stable anchoring of the feet 4, especially on sites where the feet of the legs have a tendency to sink in due to the instability of some layers of the subsoil.

For the purpose of increasing the overload applied to the legs in order to comply with safety standards, the platform is provided with, in addition to the integrated chambers 10, additional loads which are temporarily lockable directly to each leg 2 of the platform when laying the legs on the sea bed 3.

Figure 3:
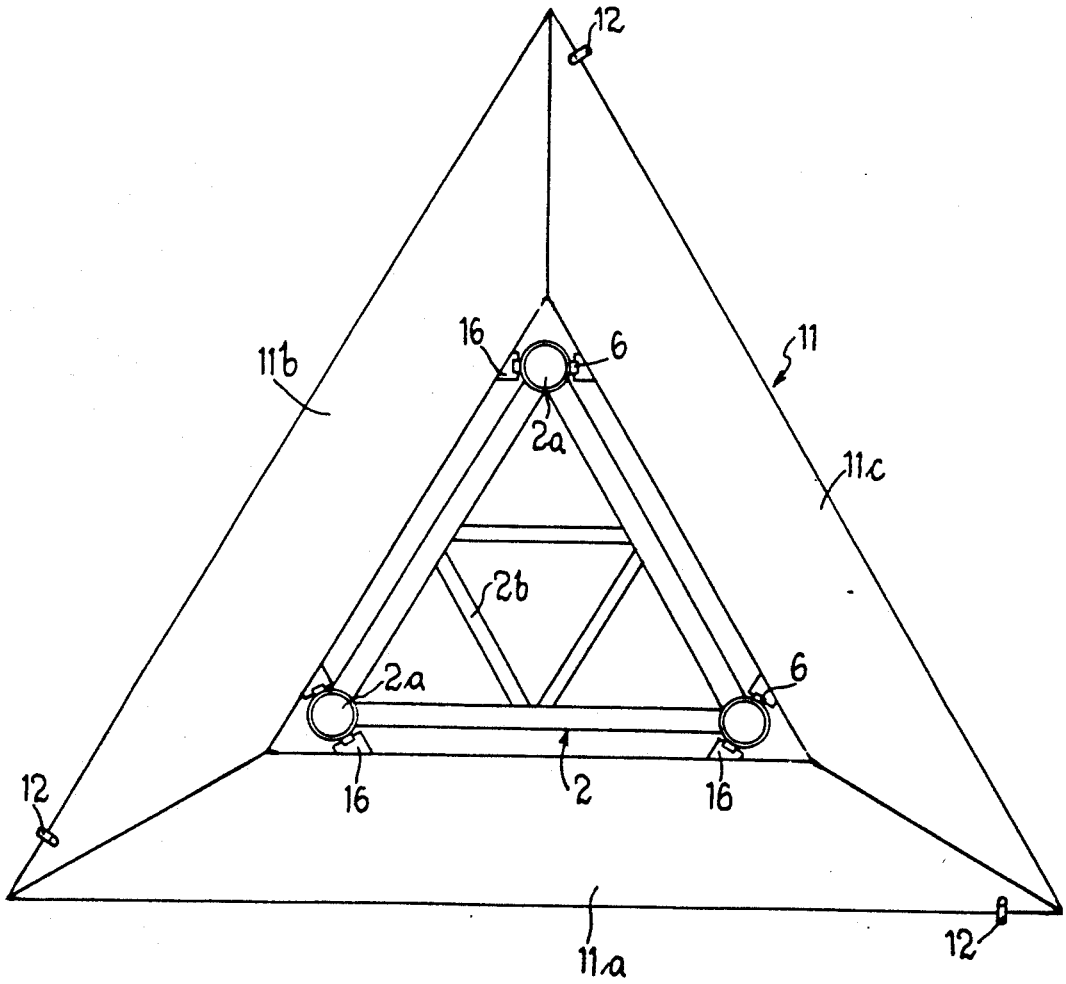
FIG. 3 is a plan view of the structure shown in FIG. 2.

As shown in FIGS. 1 to 3, the additional loads are formed by at least one removable reservoir 11 supported by each carrying structure 9 for the jack mechanisms 5 of each leg 2.

Preferably, each reservoir 11 is divided into a plurality of independent enclosures 11*a*, 11*b* and 11*c* which are lockable to one another by suitable means (not shown). Thus, each reservoir 11 may be installed directly from the side of the corresponding leg 2 (i.e. assembled around the leg 2), which avoids the necessity mounting it from the top of the leg.

Each enclosure 11*a*, 11*b*, and 11*c* is provided with filling means 12, for example constituted by a supply valve, and draining means 13, for example constituted by a discharge valve.

The filling means 12 are connected through an extensible pipe 14 to a pump (not shown) which supplies, for example, sea water.

The enclosures 11*a*, 11*b* and 11*c* rest against each carrying structure 9 through blocks 15 of elastic material.

Further, each enclosure 11*a*, 11*b* and 11*c* is provided with means 16 (FIG. 3) for connecting it to the legs 2 of the platform and in particular to the racks 6.

The means 16 can be arranged to be automatically unlocked, for example, when the force exerted on the blocks 15 by the carrying structure 9, as detected by a sensor integrated with one of the blocks, exceeds a predetermined threshold value.

These connecting means 16 comprise, for example, counterracks associated with locking and unlocking means or ratchet wheels.

The reservoirs 11 may be formed by rigid enclosures or enclosures composed of a flexible material placed, for example, in frames in the form of cradles.

In another variant, the reservoirs 11 may be formed as a single piece and comprise a door permitting a direct mounting from the side of the legs.

The placing in position of the platform on the drilling or production site will now be described with reference to FIGS. 4*a* to 4*f*.

The platform is brought in a floating state to the drilling or production site (FIG. 4*a*) and the legs 2 are lowered into contact with the sea bed 3.

By bearing against the legs 2, the hull 1 is jacked up by the jack mechanisms 5 in cooperation with the racks 6 to a height which puts it out of reach of the highest waves at the time of installation (FIG. 4*b*).

The hull 1 is then jacked up by the jack mechanisms 5 with respect to the level of the sea (FIG. 4*c*) and the reservoirs 11 are locked to the legs 2 by the connecting means 16.

The hull 1 is then lowered to the preceding level which puts it out of reach of the highest waves at the time of installation, the reservoirs 11 being locked to the legs 2 at a higher level (FIG. 4*d*).

Subsequent to these operations, the chambers 10 integrated with the hull 1 are filled with sea water by suitable means.

This results in the application of a first overload on the legs 2, so that the feet 4 more or less sink into the sea bed, depending on the composition of this sea bed.

Simultaneously with or following the filling of the chambers 10, the reservoirs 11 are also filled with sea water by the filling means 12 and pipes 14. The filling of these reservoirs 11 results in the application of an additional overload on each leg 2 so that the foot 4 sinks still further into the sea bed 3 in a more stable manner.

The reservoirs 11 are then emptied by the draining means 13 together with the integrated chambers 10, and the hull 1 is again jacked up by means of the jack mechanisms 5 in such manner that the reservoirs 11 again bear against the carrying structure 9 after the reservoirs 11 have been unlocked from the legs 2 (FIG. 4*e*).

The hull 1 is then jacked up to its position out of reach of the highest waves which may occur during production on the site (FIG. 4*f*).

Figure 5:
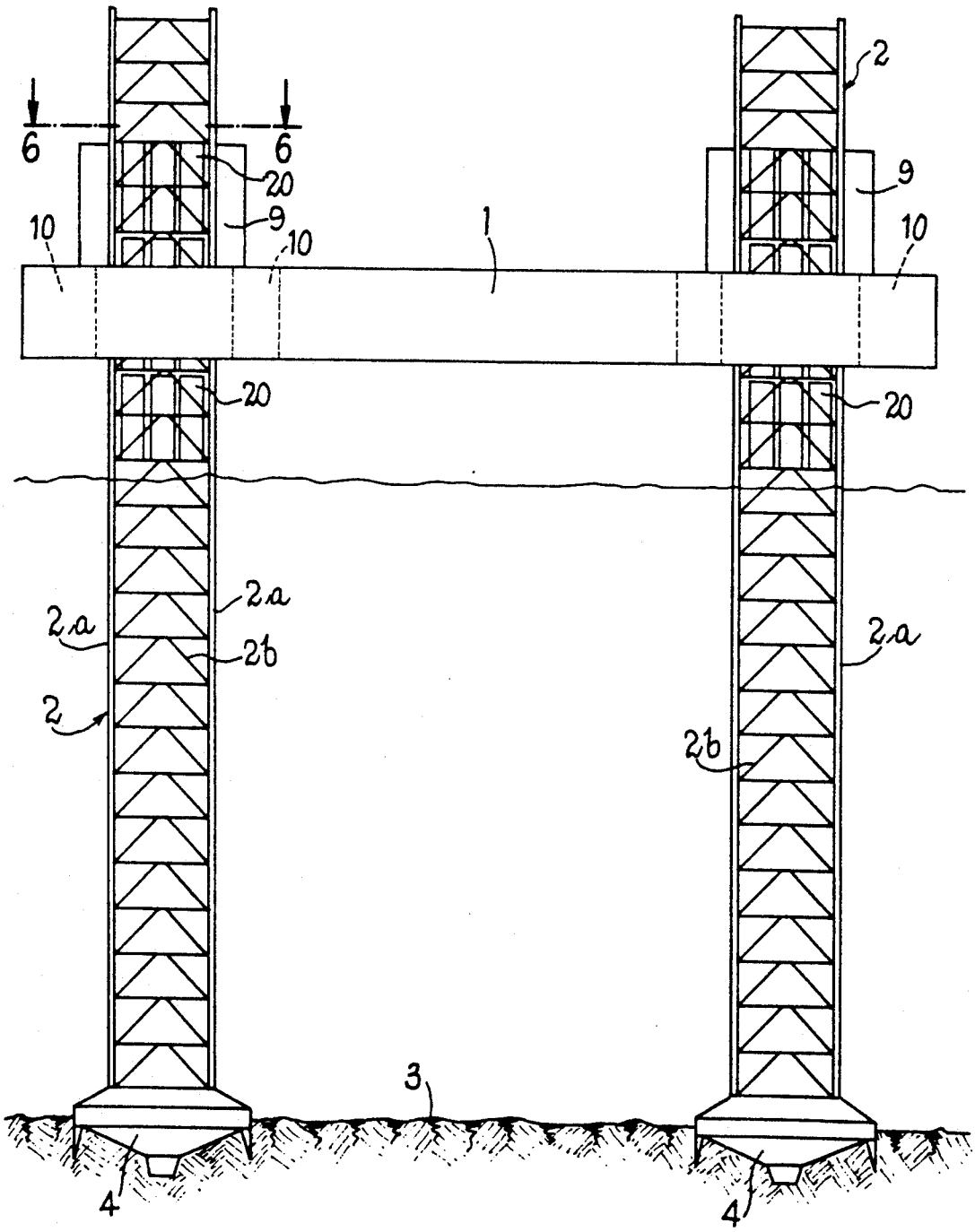
FIG. 5 is a diagrammatic elevational view of a jack-up oil platform provided with an overloading device according to another embodiment.
Figure 7:
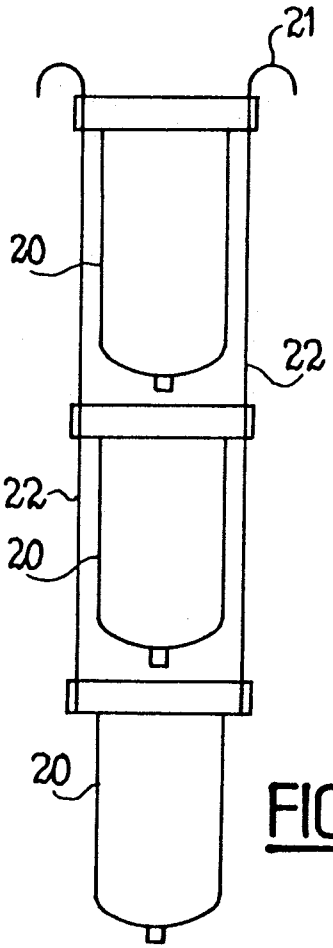
FIG. 7 is a view on a larger scale of reservoirs employed in the device shown in FIGS. 5 and 6.
Figure 6:
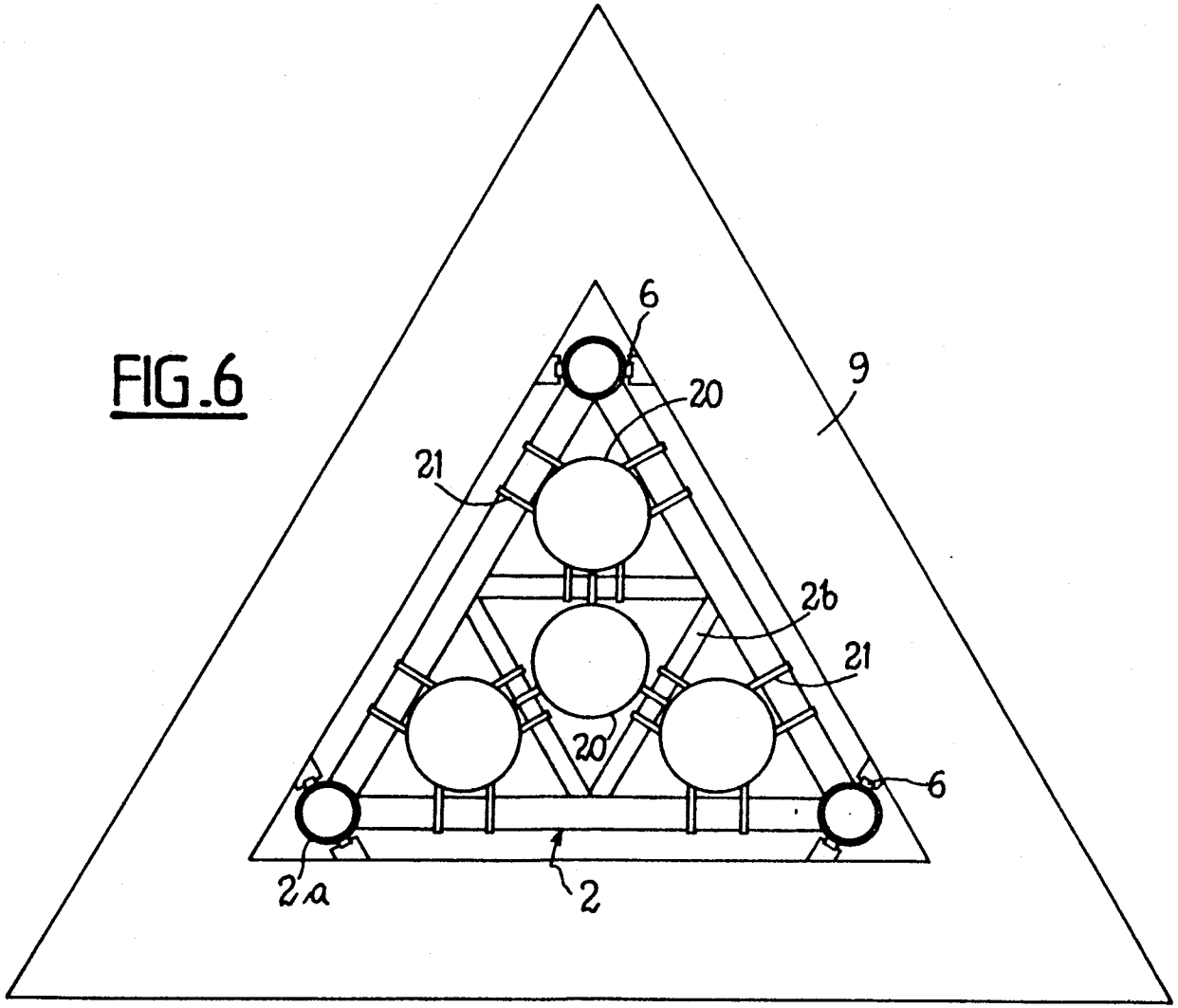
FIG. 6 is a sectional view taken on line 6—6 of FIG. 5.

In another embodiment shown in FIGS. 5 to 7, the reservoirs forming the additional load are formed by elongated flexible bags 20 disposed directly within the jacket or lattice structures 2*b* of each leg.

Each bag 20 includes, in its upper part, means 21 for clamping it to the metal girders of the jackets 2*b* of the legs 2.

Thus, four bags 20 may be placed within each leg 2 (FIG. 6). Each bag 20 is also provided with means (not shown) for filling it with sea water.

Further, a plurality of bags 20 may be placed one above the other and interconnected by suspension means 22 (FIG. 7). The superimposed bags 20 communicate with one another to provide for the billing if each bag 20 in succession.

This arrangement therefore, permits applying, when laying the legs 2 on the sea bed 3, an additional overload on each of these legs.

Therefore, while being simple in construction and easy to use, the device according to the invention therefore permits applying on the legs of the platform the desired overload so as to comply with the safety standards and yet avoid applying this overload through the jack mechanisms of the platform.

Moreover, the device according to the invention enables this overload to be modified in accordance with the prevailing safety standards.

What is claimed is:

1. A jack-up oil platform comprising:

a plurality of vertically extending legs;

a hull movably mounted to said legs for vertical movement therealong;

a plurality of carrying structures fixed to said hull and disposed adjacent said legs, respectively;

an overloading device comprising a plurality of auxiliary reservoirs movably mounted relative to said legs, respectively, for longitudinal movement therealong, and locking means for removably and positively locking said auxiliary reservoirs directly to said legs to prevent said auxiliary reservoirs from moving along said legs, respectively, said auxiliary reservoirs being supported on said carrying structures when not locked to said legs, respectively; and jacking means for raising and lowering said carrying structures relative to said legs and for raising and lowering said auxiliary reservoirs when said auxiliary reservoirs are not locked to said legs, such that when said carrying structures are raised into contact with said auxiliary reservoirs and said auxiliary reservoirs are not locked to said legs, further raising of said carrying structures causes raising of said auxiliary reservoirs to desired locations along said legs, and such that, once said auxiliary reservoirs have been locked to said legs by said locking means at said desired locations, said carrying structures can be lowered while said auxiliary reservoirs remain in said desired locations, respectively.

2. A jack-up oil platform as recited in claim 1, wherein each of said plurality of auxiliary reservoirs comprises at least one rigid enclosure.

3. A jack-up oil platform as recited in claim 1, further comprising elastic blocks interposed between said carrying structures and said auxiliary reservoirs, respectively.

4. A jack-up oil platform as recited in claim 1, wherein each of said auxiliary reservoirs is mounted about an outer periphery of each of said legs, respectively.

5. A jack-up oil platform as recited in claim 1, wherein at least one vertically elongated rack extends along each of said plurality of legs; and said jacking means comprises at least one jack mechanism mounted in each of said plurality of carrying structures and comprising an output pinion gear operatively engaged with said at least one rack and a drive means for drivingly rotating said output pinion gear.

6. A jack-up oil platform as recited in claim 5, wherein said locking means comprises, for each of said auxiliary reservoirs, an engaging means for positively and directly engaging said at least one rack.

* * * * *